US009405251B2

(12) United States Patent
Tanaka

(10) Patent No.: US 9,405,251 B2
(45) Date of Patent: Aug. 2, 2016

(54) IMAGE FORMING APPARATUS WITH MOVING MECHANISM CONFIGURED TO MOVE AT LEAST ONE OF HEATING MEMBER AND PRESSING MEMBER BETWEEN FIRST, SECOND, AND THIRD RELATIVE POSITIONS THEREBETWEEN

(71) Applicant: CANON KABUSHIKI KAISHA, Tokyo (JP)

(72) Inventor: Masanobu Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/717,221

(22) Filed: May 20, 2015

(65) Prior Publication Data

US 2015/0338807 A1 Nov. 26, 2015

(30) Foreign Application Priority Data

May 21, 2014 (JP) ..... 2014-105180

(51) Int. Cl.
*G03G 15/20* (2006.01)

(52) U.S. Cl.
CPC ..... *G03G 15/2085* (2013.01); *G03G 15/2032* (2013.01); *G03G 15/2067* (2013.01); *G03G 15/2035* (2013.01)

(58) Field of Classification Search
CPC ..... G03G 15/2032; G03G 15/2035; G03G 15/2046; G03G 15/2085
USPC ..... 399/122
See application file for complete search history.

(56) References Cited

U.S. PATENT DOCUMENTS 5,693,243 A * 12/1997 Kueppers ..... B32B 37/06 219/216
6,999,692 B2 * 2/2006 Shimura ..... G03G 15/2046 399/43
7,392,005 B2 * 6/2008 Kaji ..... G03G 15/2032 399/328

(Continued)

FOREIGN PATENT DOCUMENTS

JP 2005-316397 11/2005
JP 2007-057786 3/2007
JP 2012-078761 4/2012

OTHER PUBLICATIONS

U.S. Appl. No. 14/716,279, filed May 19, 2015.

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

An image forming apparatus includes: an image forming station; heating and pressing rollers forming a fixing nip therebetween; a mechanism for changing the relative positional relation between the heating and pressing rollers between a contacting position in which they contact each other, a first spacing position in which they are spaced, and the second spacing position in which they are spaced by a shorter distance; and a controller for controlling the changing mechanism such that in a period after the sheet passes through the fixing nip and before a next sheet reaches the fixing nip, the rollers are brought into the first spacing position when the period is longer than a first predetermined period, and that the rollers are brought into the second spacing position when the period is shorter than the first predetermined period and is longer than a second predetermined period.

9 Claims, 11 Drawing Sheets

(56) References Cited

U.S. PATENT DOCUMENTS

| | | | | |
|---|---|---|---|---|
| 8,655,213 | B2 | 2/2014 | Tanaka et al. | |
| 8,666,273 | B2 | 3/2014 | Tanaka | |
| 8,989,640 | B2 | 3/2015 | Kitagawa et al. | |
| 2005/0220466 | A1* | 10/2005 | Takahashi | G03G 15/2039 399/45 |
| 2010/0322667 | A1* | 12/2010 | Kitagawa | G03G 15/2035 399/122 |
| 2011/0311251 | A1* | 12/2011 | Furuyama | G03G 15/2046 399/45 |
| 2013/0206745 | A1 | 8/2013 | Tanaka et al. | |
| 2014/0205307 | A1 | 7/2014 | Tanaka | |
| 2015/0037055 | A1 | 2/2015 | Kitagawa et al. | |

* cited by examiner (a)

(b)

IMAGE FORMING APPARATUS WITH MOVING MECHANISM CONFIGURED TO MOVE AT LEAST ONE OF HEATING MEMBER AND PRESSING MEMBER BETWEEN FIRST, SECOND, AND THIRD RELATIVE POSITIONS THEREBETWEEN

FIELD OF THE INVENTION AND RELATED ART

The present invention relates to an image forming apparatus such as a copying machine, a printer, a facsimile machine and a multifunction machine having a plurality of functions thereof.

It is known in the image forming apparatus that an image formed by an image forming station is transferred onto a sheet, and then is fixed on the sheet using a fixing device.

Japanese Laid-open Patent Application 2005-316397 discloses a fixing device in which a belt is contacted to a fixing roller, and the sheet is passed through between them to fix the image on the sheet.

In such a fixing device, the belt is gradually heated by the heat of the fixing roller since the belt (pressing rotatable member) is contacted to the fixing roller. When a temperature of the belt rises excessively for one reason or another, an image defect may result, and therefore, it is desired to suppress excessive temperature rise of the belt. In the fixing device disclosed in Japanese Laid-open Patent Application 2005-316397, when a continuous job operation temporary stops with the result of interval of the sheet feeding, the belt is spaced from the fixing roller so that the excessive heating of the belt by the fixing roller is suppressed.

However, in the fixing device disclosed in Japanese Laid-open Patent Application 2005-316397, the belt cannot be spaced from the fixing roller when the sheet feeding clearance is short, and therefore, the excessive temperature rise of the belt in such a case is not sufficiently suppressed. More in detail, when the time required to space the belt from the fixing roller and then to return it to the original position is longer than the pause period, the resumption of the job will be delayed until a belt is returned to the position of contact to the fixing roller. The delay of the resumption of the job will lead to the reduction of the through-put.

SUMMARY OF THE INVENTION

Accordingly, it is an object of the present invention to provide an image forming apparatus with which the reduction of the productivity is suppressed.

According to an aspect of the present invention, there is provided an image forming apparatus comprising an image forming station capable of continuously forming on a plurality of sheets; a rotatable heating member and a pressing rotatable member cooperative with each other to form a fixing nip configured to fix the images formed by the image forming station on the sheets; a changing mechanism for changing a relative positional relation between said rotatable heating member and said pressing rotatable member between a contacting position in which said rotatable heating member and said pressing rotatable member are contacted with each other, a first spacing position in which said rotatable heating member and said pressing rotatable member are spaced from each other, and the second spacing position in which said rotatable heating member and said pressing rotatable member are spaced from each other by a distance shorter than that in the first spacing position; and a controller for controlling said changing mechanism such that in a period after the sheet passes through the fixing nip and before a next sheet reaches the fixing nip, the positional relation is brought into the first spacing position when the period is longer than a first predetermined period, and that the positional relation is brought into the second spacing position when the period is shorter than the first predetermined period and is longer than a second predetermined period.

Figure 7:
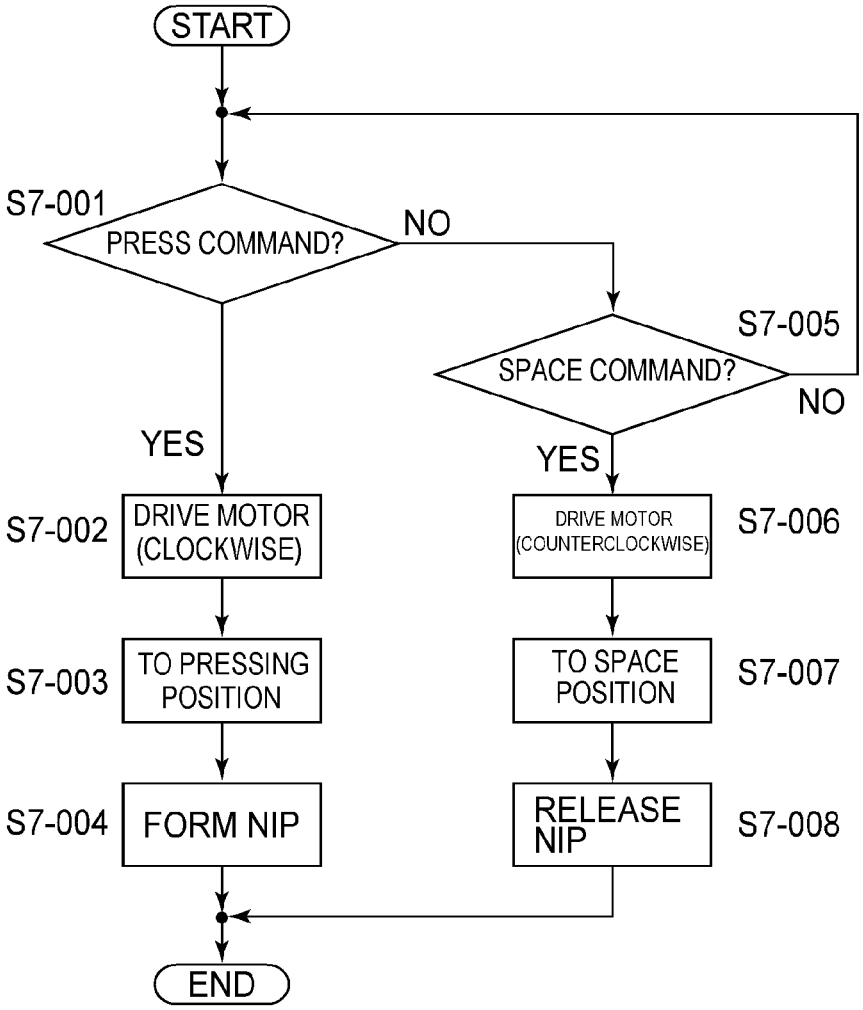
Figure 7:
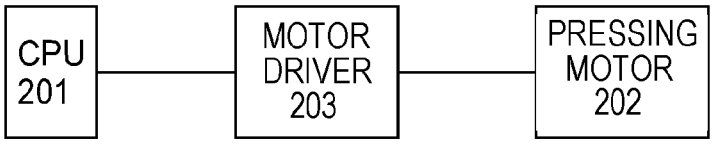

Part (a) of FIG. 7 is a sequence chart and part (b) of FIG. 7 is a block diagram of a mounting and demounting operation control in Embodiment 1.

Figure 8:
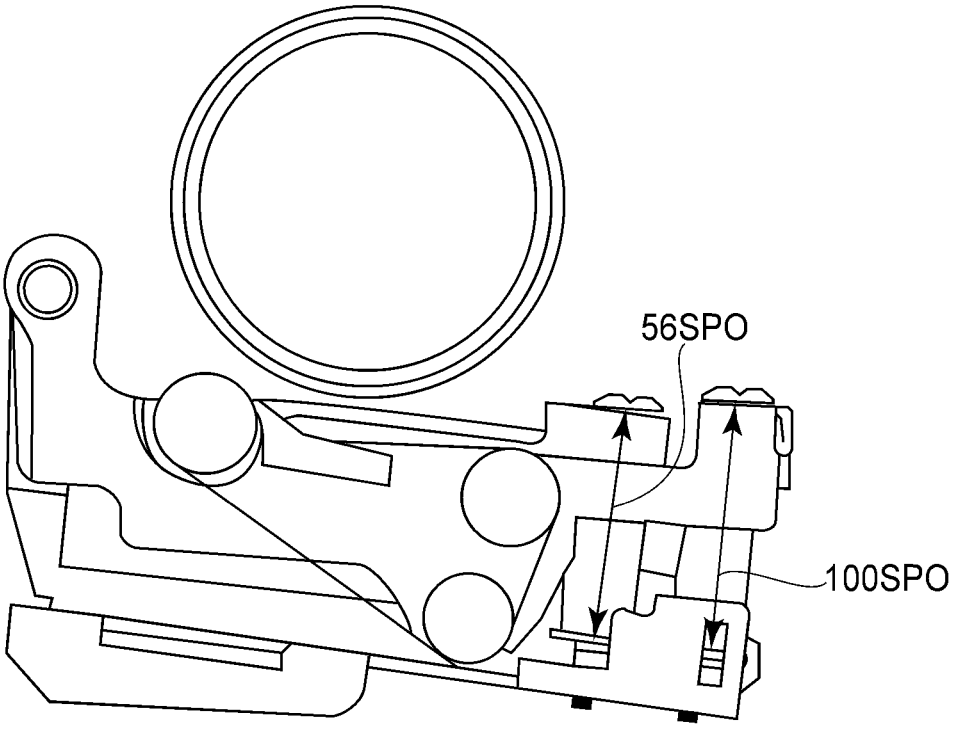

FIG. 8 illustrates the pressing unit in a semi-spaced state in Embodiment 1.

Figure 9:
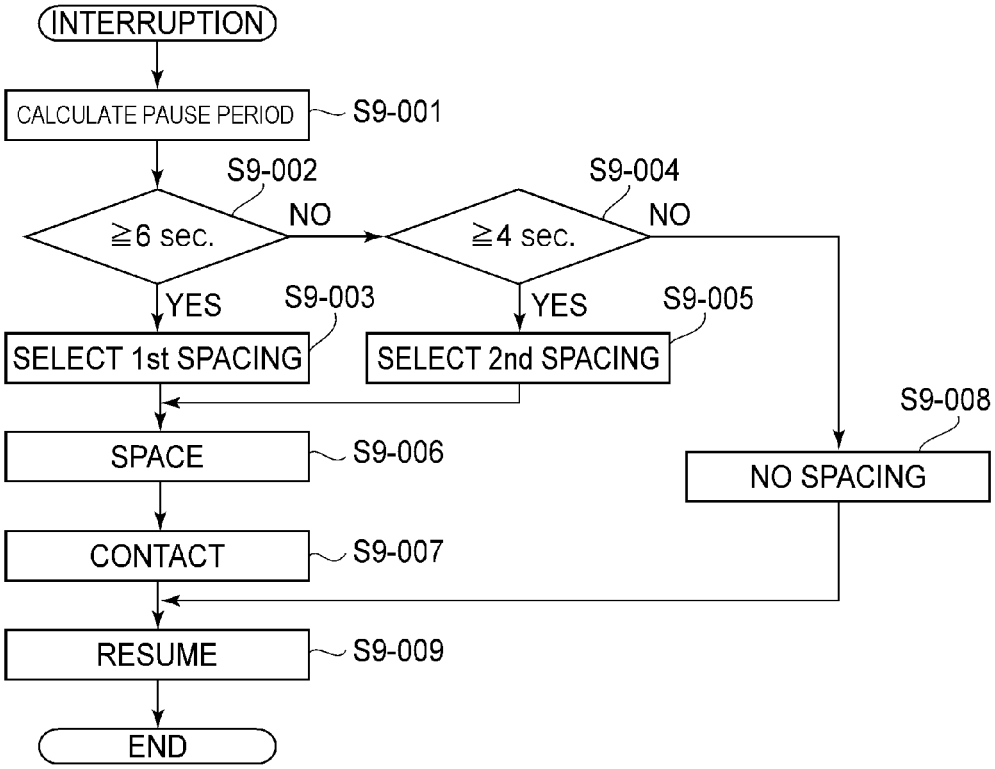

FIG. 9 is a sequence chart of a temporary spacing mode in Embodiment 1.

Figure 10:
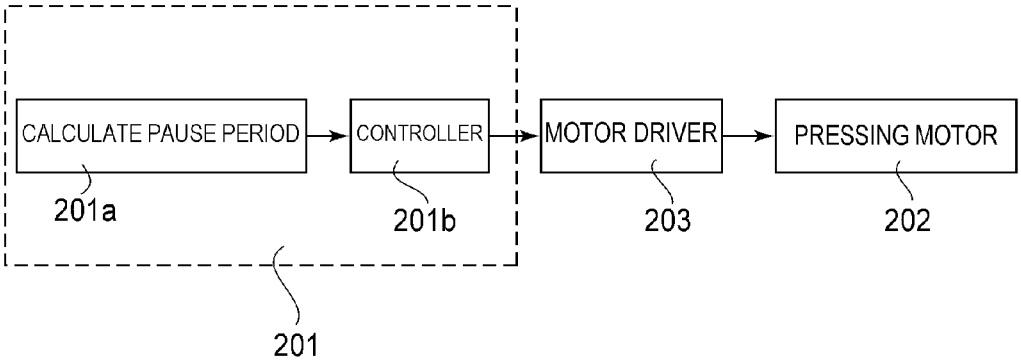

FIG. 10 is a control block diagram relating to a temporary spacing mode in Embodiment 2.

Figure 11:
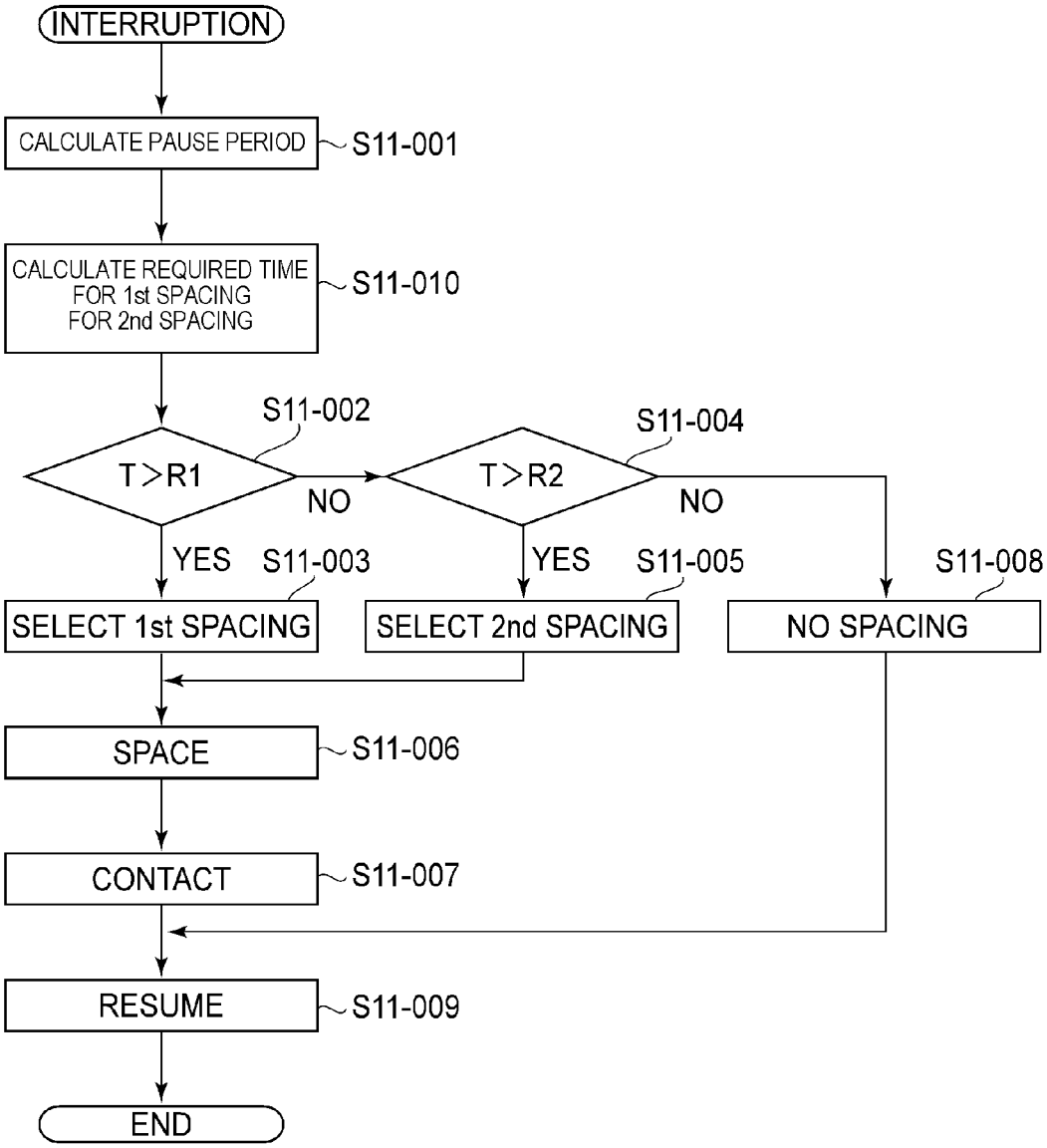

FIG. 11 is a sequence chart of a temporary spacing mode in Embodiment 2.

Figure 12:
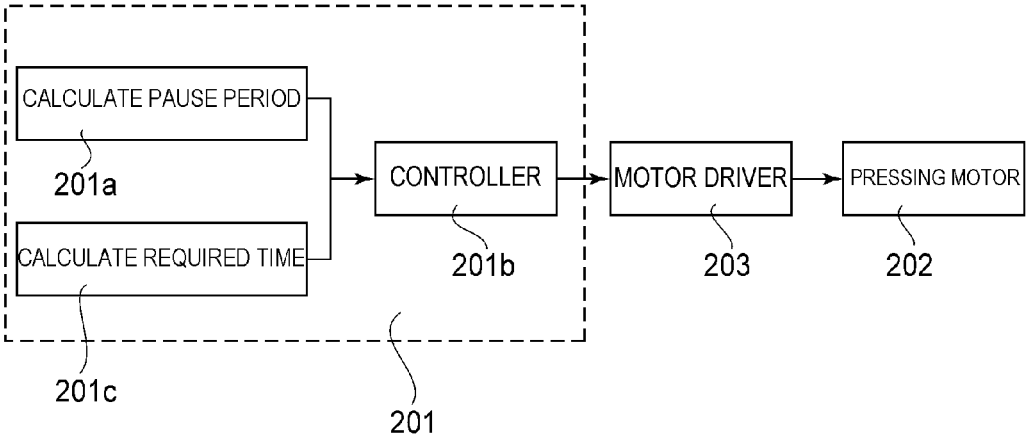

FIG. 12 is a control block diagram relating to a temporary spacing mode in Embodiment 1.

Figure 13:
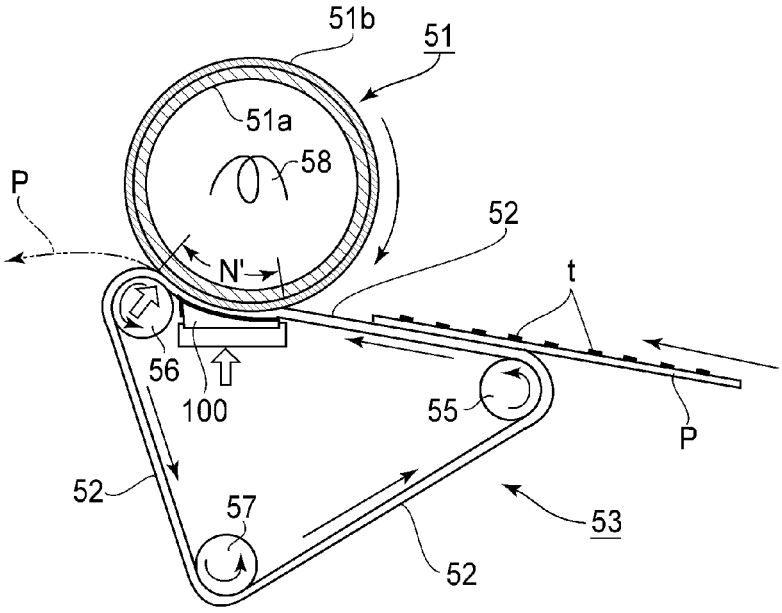

FIG. 13 illustrates a structure of a belt nip type fixing device according to a conventional example.

Figure 14:
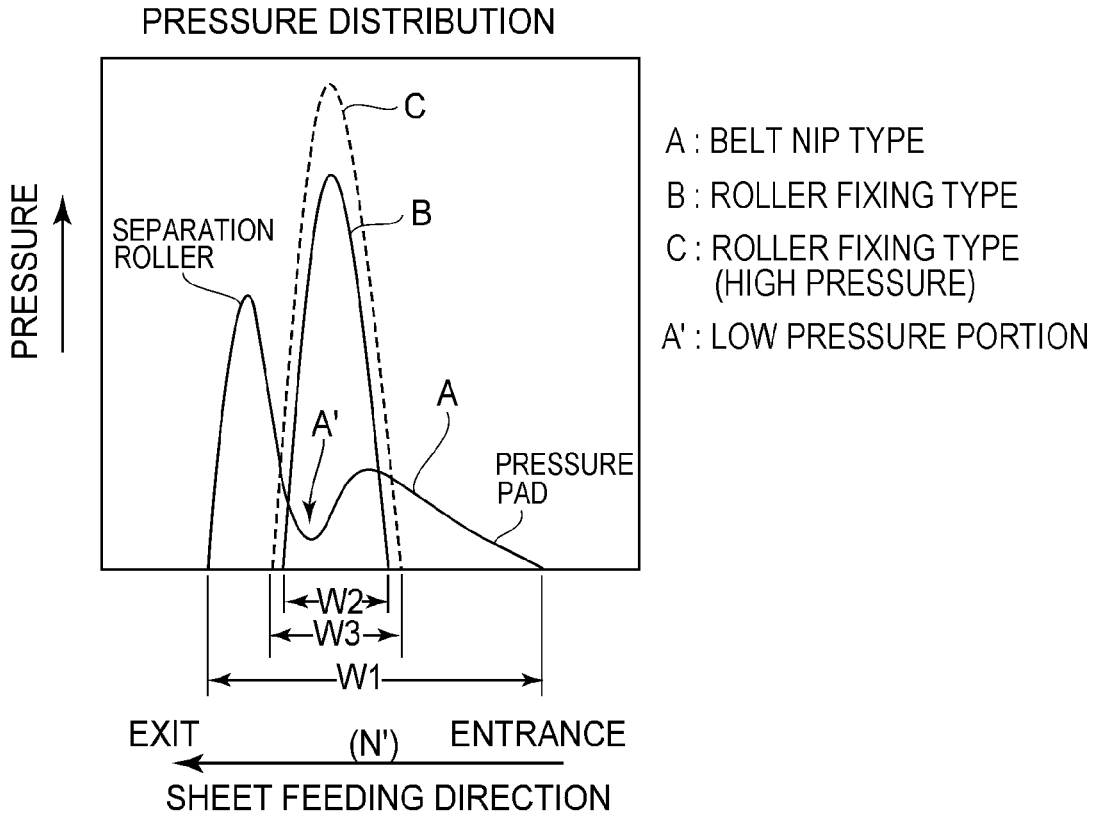

FIG. 14 is a graph of comparison of a pressure distribution in a fixing nip of the conventional example roller type fixing device and a fixing device of a belt nip type.

Figure 15:
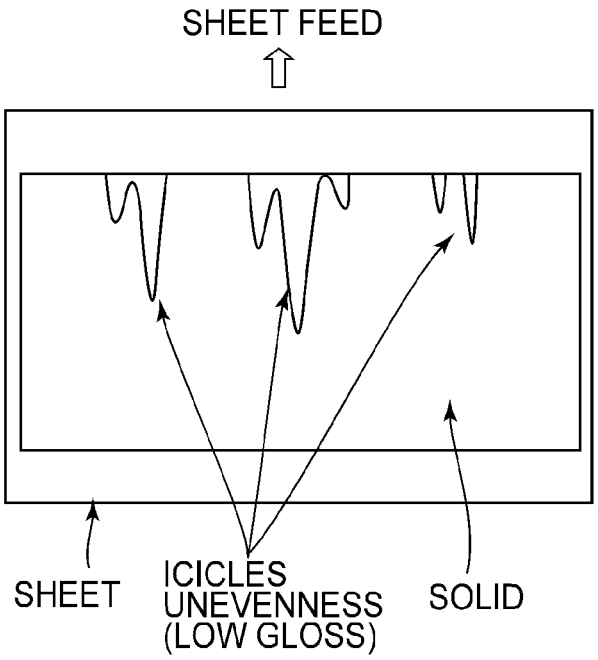

FIG. 15 shows an image defect of glossiness non-uniformity in the form of icicles.

Figure 16:
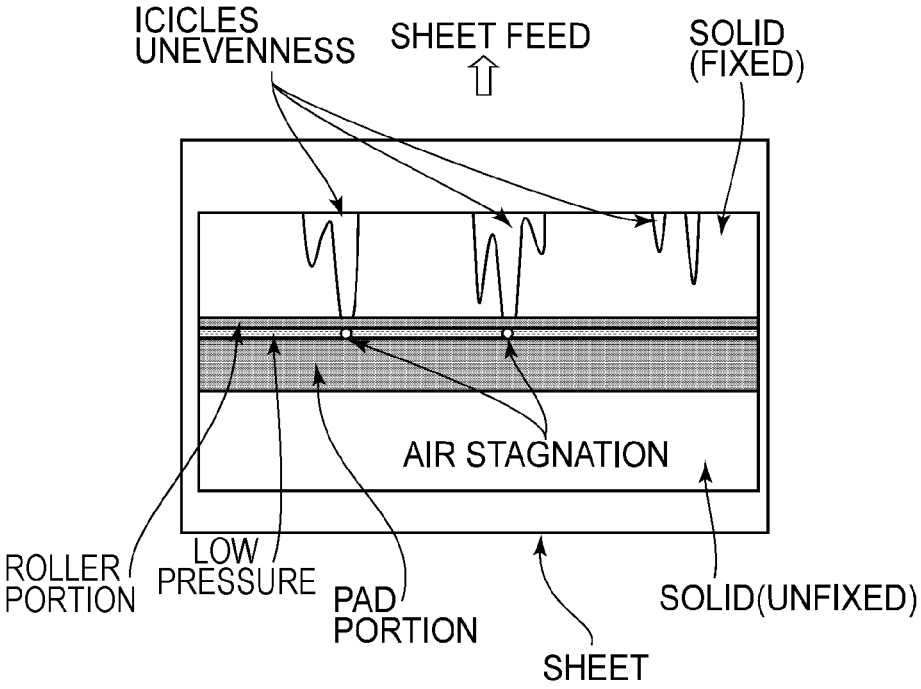

FIG. 16 illustrates stagnation of the air attributable to the icicles-like glossiness non-uniformity.

DESCRIPTION OF THE EMBODIMENTS

The embodiments of the present invention will be described in conjunction with the accompanying drawings. The present invention is not limited to the specific structures of the following embodiments. The present invention includes various modifications within the concept of the present invention.

Embodiment 1

Figure 1:
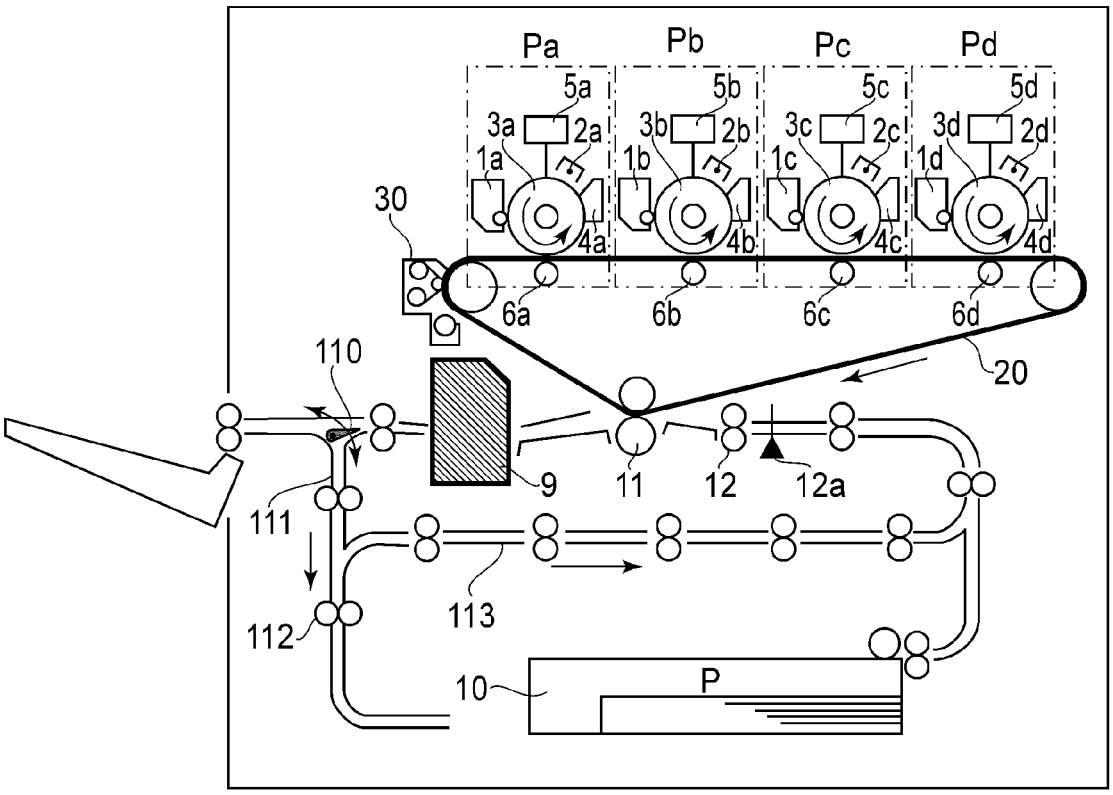
FIG. 1 shows a general arrangement of an image forming apparatus according to Embodiment 1 of the present invention.

The image forming apparatus of this embodiment is a printer of an electrophotographic type. FIG. 1 is a general arrangement of an image forming apparatus (printer) of an electrophotographic type. The image forming apparatus carries out, printing operation (job) in accordance with instructions supplied from an UI or PC. The printer is capable of carrying out a printing operation (continuous job) of image formations continuously on sheets in response to one instruction (printing signal).

As shown in FIG. 1, image forming stations Pa, Pb, Pc, and Pd are provided in the image forming apparatus. Each image forming station forms a toner image of different colors through a latent image formation, a development and image transfer.

(Image Forming Station)

The image forming stations Pa, Pb, Pc, and Pd include respective image bearing members, namely respective electrophotographic photosensitive drums 3*a*, 3*b*, 3*c*, 3*d* in this embodiment. On the photosensitive drums 3*a*, 3*b*, 3*c*, 3*d*, toner images of the respective colors are formed. An intermediary transfer member 20 is provided adjacent to the photosensitive drums 3*a*, 3*b*, 3*c*, 3*d*. The toner images formed on the respective photosensitive drums 3*a*, 3*b*, 3*c*, 3*d* are primary-transferred onto the intermediary transfer member 20 in the primary transfer portion, and are secondary-transferred onto a sheet (transfer material, recording material or sheet) P in a secondary transfer portion. The sheet P now having the transferred toner images is subjected to heating and by the fixing portion 9, so that the toner image is fixed. The sheet P now having the fixed image is then discharged to an outside of the apparatus.

Around the photosensitive drums 3*a*, 3*b*, 3*c*, 3*d*, there are provided drum chargers 2*a*, 2*b*, 2*c*, 2*d*, developing devices 1*a*, 1*b*, 1*c*, 1*d*, primary transfer chargers 6*a*, 6*b*, 6*c*, 6*d*, and cleaners 4*a*, 4*b*, 4*c*, 4*d*, respectively.

In the upper part of the image forming apparatus, laser scanners 5*a*, 5*b*, 5*c*, 5*d* are provided. The laser scanners 5*a*, 5*b*, 5*c*, 5*d* comprise light source devices (unshown) and polygonal mirrors (unshown), respectively. A laser beam emitted from the light source device is scanningly deflected by a rotational polygonal mirror and is deflected by a reflection mirror. The beam is condensed on the photosensitive drum 3*a*, 3*b*, 3*c*, 3*d* by a fθ lens (unshown) to scan it along the generatrix thereof, by which the surface of the photosensitive drum 3*a*, 3*b*, 3*c*, 3*d* is exposed to the beam. With the above-described structure, a latent image is formed corresponding to the image signal on the photosensitive drum 3*a*, 3*b*, 3*c*, 3*d*.

The developing devices 1*a*, 1*b*, 1*c*, 1*d* contain cyan, magenta, yellow and black toner particles as developers. The developing devices 1*a*, 1*b*, 1*c*, 1*d* develop the latent images on the photosensitive drums 3*a*, 3*b*, 3*c*, 3*d* into a cyan toner image, a magenta toner image, a yellow toner image and a black toner image, respectively.

The intermediary transfer member 20 is rotated at a peripheral speed same as the photosensitive drums 3*a*, 3*b*, 3*c*, 3*d* in a direction indicated by the arrow (FIG. 1). The intermediary transfer member 20 is supplied with a primary transfer bias, by which the toner images on the photosensitive drums are transferred onto the intermediary transfer member.

More particularly, a yellow toner image (first color) formed on the photosensitive drum 3*a* is transferred onto an outer peripheral surface of the intermediary transfer member 20 by pressure and force of electric field while passing through the nip between the photosensitive drum 3*a* and the intermediary transfer member 20.

Similarly, the magenta toner image (second color), cyan toner image (third color), black toner image (fourth color) are sequentially and superimposedly transferred onto the intermediary transfer member 20, so that a synthesized color toner image corresponding to the object of is formed. In this embodiment, the synthesized color toner image is formed leaving predetermined marginal blank portions at four sides of the sheet P.

A secondary transfer roller 11 is supported by bearings in parallel with the intermediary transfer member 20 and is contacted to the lower surface portion of the intermediary transfer member 20. The secondary transfer roller 11 is supplied with a secondary transfer bias voltage by a secondary transfer bias voltage source. The synthesized color toner image on the intermediary transfer member 20 is transferred onto the sheet P in the following manner. The sheet P is fed to the contact nip between the intermediary transfer member 20 and the secondary transfer roller 11 at predetermined timing from the sheet cassette 10 through between the registration rollers 12, and along a pre-transfer prior guide. The secondary transfer roller is supplied with the secondary transfer bias voltage from a bias voltage source. By the secondary transfer bias voltage, the synthesized color toner image is transferred from the intermediary transfer member 20 onto the sheet P.

After the primary-transfer, the photosensitive drums 3*a*, 3*b*, 3*c*, 3*d* are cleaned by respective cleaners 4*a*, 4*b*, 4*c*, 4*d* so that the untransferred toner is removed. In this manner, the image forming stations a capable of forming an image is continuously on the sheets.

In the toner and other foreign matter remaining on the intermediary transfer member 20 is wiped off by a cleaning web (nonwoven fabric) contacting with the surface of the intermediary transfer member 20. The sheets P now having the transferred toner images are sequentially introduced to the fixing device 9 and are subjected to an image fixing operation is by heat and pressure.

In the case of both side printing, the sheet P fed from the feeding cassette 10 is fed between the registration rollers 12, along the pre-transfer prior guide and through the contact nip between the intermediary transfer member 20 and the secondary transfer roller 11, and then is subjected to the fixing operation. Thereafter, the sheet P is guided into a reversion path 111 by a flapper 110. Thereafter, the sheet P is reverted by reversing rollers 112 and fed to the both-side-printing path 113.

The sheet P is fed into the fixing device 9 through between the registration rollers 12, along the pre-transfer prior guide and through the contact nip between the intermediary transfer member 20 and the secondary transfer roller 11, and is subjected to the fixing operation of the second side of the sheet P. While the image is being formed on the second side of the sheet P, the flapper 110 is switched back, so that the sheet P having a user on the respective sides is discharged to an outside of the apparatus as a print.

(Fixing Device)

Figure 2:
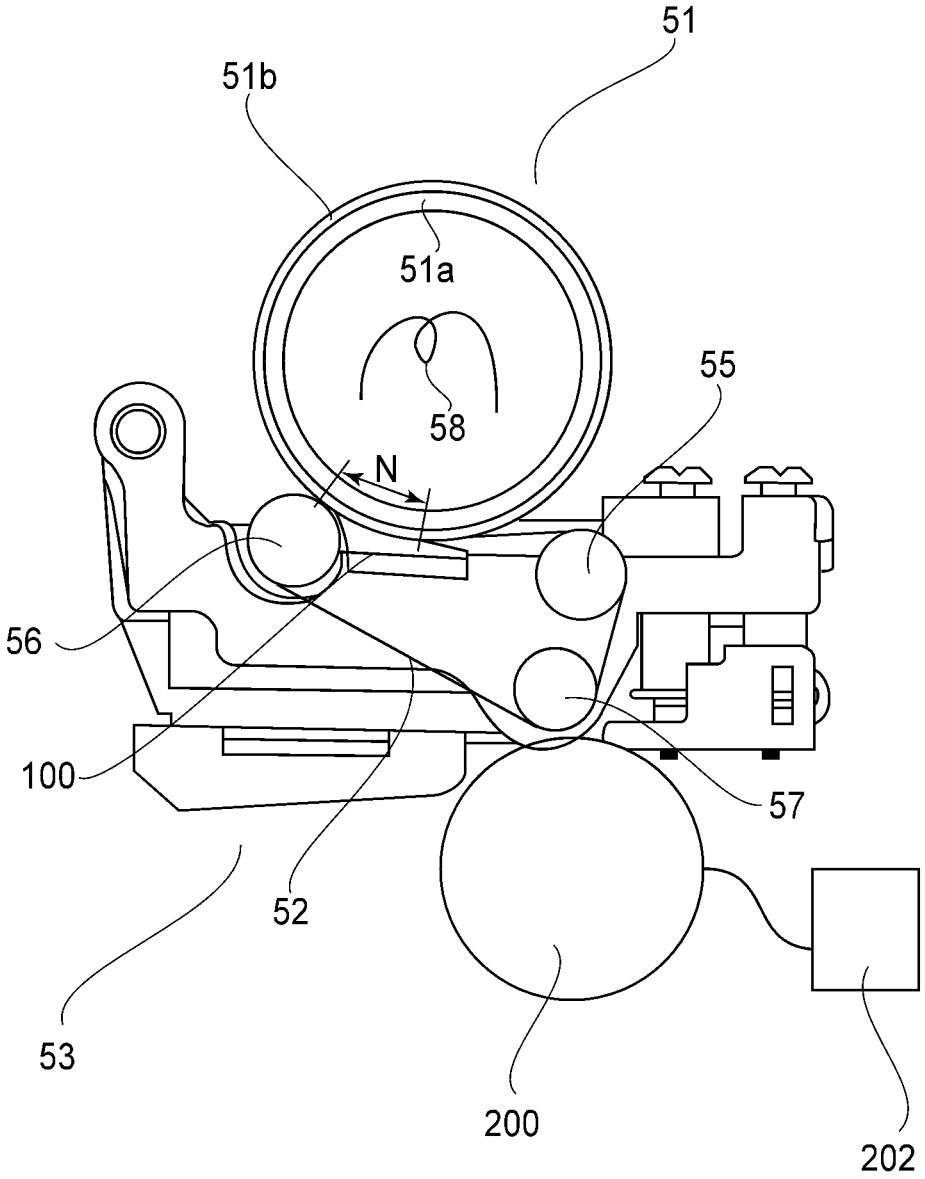
FIG. 2 illustrates a structure of a fixing device according to Embodiment 1.

Referring to FIG. 2, the fixing device 9 of this embodiment will be described. The fixing device 9 includes a fixing roller 51 capable of being heated by a heater 58 as a heating source. The fixing roller 51 is pressed by a pressing unit 53 and cooperates with the pressing unit 53 to form a fixing nip (nip, heating nip) N. The fixing roller 51 fixes the toner image in the fixing nip N.

Thus, the fixing roller 51 and the pressing unit 53 constitutes a pair of rotatable members and forms a heating nip for heating the image on the sheet.

The fixing roller 51 in this embodiment comprises a core metal of steel 51*a* having an inner diameter of ϕ37.8, an outer configuration of ϕ38.4 and a thickness of 0.3 mm. On the core metal, a silicone rubber layer of 0.5 mm thick is provided as an elastic layer 51*b*, and on the rubber layer, a PFA tube of 30 μm thick as a parting layer is provided. The outer diameter of the fixing roller 51 is ϕ40 mm.

The pressing unit 53 (opposing member) disposed opposed to the fixing roller 51 is a pressing rotatable member for pressing the fixing roller 51. The pressing unit includes a pressing belt 52 (endless belt) extending around three rollers namely, an entrance roller 55 the separation roller 56 and a tension roller 57. These rollers are rotatable together with the belt. More specifically, the separation roller 56 is connected with a driving motor (unshown) as a driving source and is rotated by the driving force received from the driving motor. The pressing belt 52 is rotated by the driving force received from the separation roller. The entrance roller 55 and the tension roller 57 are driven by the pressing belt 52. A heat source such as a heater may be provided in any of the rollers. However, the heater functions to maintain the temperature of the belt 52 at the level (90 degree C., for example) which is lower than the temperature of the fixing roller and does not promote excessive temperature rise of the belt 53.

The pressing belt 52 of this embodiment comprises a base layer of polyimide having a thickness of 100 μm. On the base layer, a silicone rubber layer of 0.2 mm thick is provided, and the outer diameter is ϕ90 mm. The pressing belt 52 of this embodiment is a seamless belt.

The entrance roller 55 is provided in an entrance side (upstream side with respect to the sheet feeding direction) where the sheet P enters the fixing device 9, and the position thereof is fixed in order to fix the feeding path for the sheet. The tension roller 57 is urged by a spring toward an outside of the pressing belt 52 from the inside of the pressing belt 52 to apply a predetermined tension to the pressing belt 52. The separation roller 56 of this embodiment is a solid roller of stainless steel (SUS). The separation roller 56 stretches the pressing belt 52 at the inner surface side at the position downstream most of the fixing nip as a heating nip.

Inside the pressing belt, there is provided a pressing pad 100 for pressing the pressing belt 52 toward the fixing roller to form the fixing nip N. In this embodiment, an opposing member opposing to the fixing roller 51 which is a first rotatable member (the other rotatable members of the pair of rotatable members) is the pressing unit 53 as a pressing rotatable member (one rotatable member of the pair of rotatable members). The pressing unit 53 is stretched around the plurality of rollers, and is provided with the pressing pad 100 for pressing the pressing belt 52 toward the fixing roller cooperates with the fixing roller 51 to nip the pressing belt 52.

Figure 3:
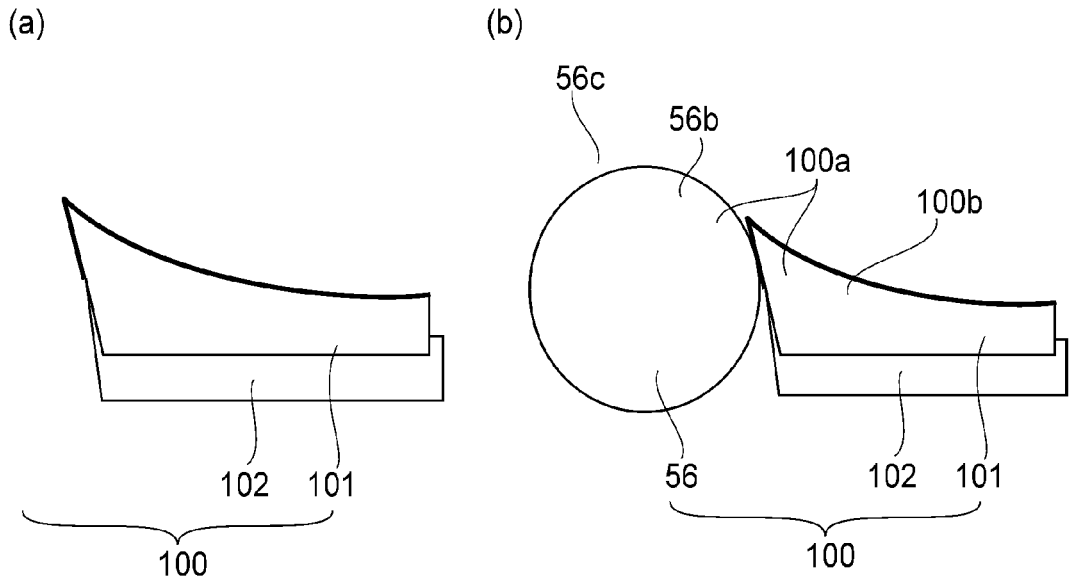
FIG. 3 illustrates a structure of a pressing pad in Embodiment 1.

As shown in part (a) of FIG. 3, the pressing pad 100 is provided with an elastic layer 101 and a base plate 102. The base plate 102 in this embodiment is made of stainless steel and has a thickness of 5 mm, and supports a downstream side surface of the elastic layer 101 with respect to the sheet feeding direction as well as the bottom portion of the elastic layer. That is, it is projected in the form of a wedge toward the press-contact portion between the fixing roller 51 and the separation roller 56 so as to back up the downstream side end portion of the elastic layer 101 with respect to the sheet feeding direction. By the end portion of the base plate backing up the end portion of the elastic layer 101, the drop of the pressure between the elastic member 100 and the separation roller 56 in the fixing nip N can be suppressed.

The elastic layer 101 is made of silicone rubber having a rubber hardness of Hs30° and has a thickness which gradually increases toward the downstream with respect to the sheet feeding direction. The elastic layer 101 of this embodiment has a curvature of radius of 16 mm and has a surface which is parallel with the base plate 102 in the nip inlet portion a. In this embodiment, the thickness of the rubber is 3 mm, and a circumferential length is 20 mm in the nip inlet portion a.

The pressing unit 53 is supported by a separation roller side plate 56P (FIG. 5) and a pressing pad side plate 100P (FIG. 5), the separation roller 56 being swingable about a predetermined center shaft, and the pressing pad 100 being swingable about the center shaft. The separation roller side plate 56P and the pressing pad side plate 100P are provided at each of the opposite end sides of the pressing unit 13 with respect to the longitudinal direction of the pressing unit 13.

Figure 5:
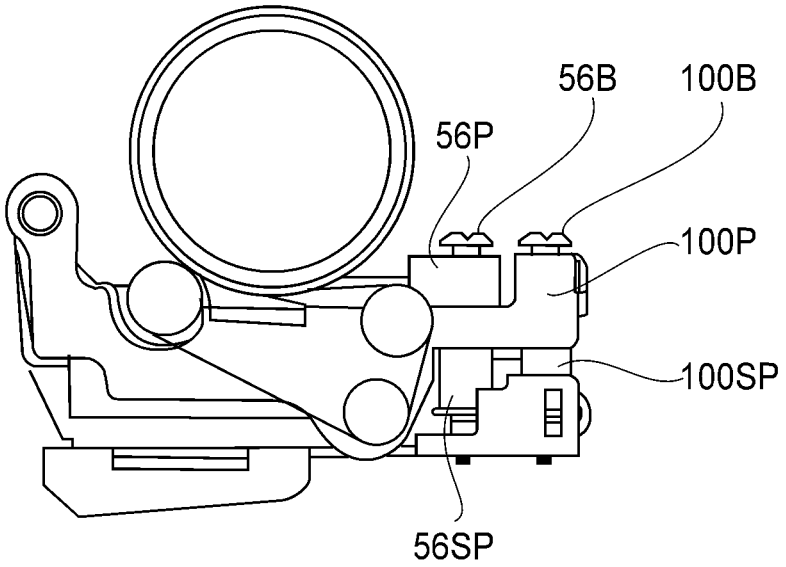
FIG. 5 illustrates pressing unit in a pressing state in Embodiment 1.

The entirety of the pressing unit 53 is pressed toward the fixing roller 51 by the separation roller spring 56SP (FIG. 5) and the pressing pad spring 100SP (FIG. 5). By a moving mechanism which will be described hereinafter, the press-contact state between the pressing unit 53 and the fixing roller 51 is released so that the pressing unit 53 is spaced. That is, the pressing unit 53 is movable between a position for pressing the pressing belt 52 to the fixing roller 51 and a position for releasing the pressing belt 52 from the fixing roller 51.

The separation roller spring 56SP and the pressing pad spring 100SP can be precisely adjusted by a separation roller screw 56B and a pressing pad screw 100B shown in FIG. 5. In the fixing device 9 of this embodiment, the pressure applied in the fixing nip N and a nip width are adjustable.

In the state that the pressing unit 53 is press-contacted to the fixing roller 51, the separation roller 56 is pressed so that it tends to bite into the elastic layer 51*b* of the fixing roller 51.

That is, the fixing nip N as a curvature in the downstream end portion with respect to the sheet feeding direction.

With such a structure, the sheet P having passed through the fixing nip N is separated from the fixing roller 51 by the curvature. In this embodiment, the separation roller 56 has an outer diameter of ϕ15 mm, and the total pressure is 392 N (40 kgf). The separation roller 56 cooperates with the fixing roller 51 to sandwich the pressing belt 52.

When the pressing unit 53 is press toward the fixing roller 51, the pressing belt 52 is press-contacted by the pressing pad 100 without space relative to the fixing roller 51. In this embodiment, the pressing pad 100 is pressed by a total pressure of 558 N (60 kgf). Therefore, the pressure of 980 N (100 kgf) which is a sum of the pressure 558 N of the pressing pad 100 and the pressure 392 N of the separation roller 56 is the total pressure between the fixing roller 51 and the pressing unit 53. In the fixing nip N, a peak pressure by the pressing pad 100 is so selected that it is smaller than a peak pressure by the separation roller 56.

Figure 4:
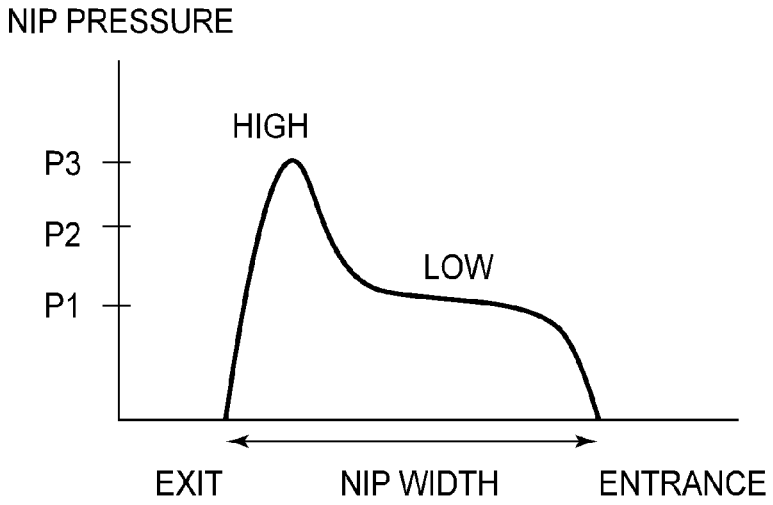
FIG. 4 is a graph showing a pressure distribution in a nip in the fixing device according to Embodiment 1.

FIG. 4 is a graph schematically showing a pressure distribution in the nip, the image heating apparatus. The abscissa is a position with respect to the sheet feeding direction, and the ordinate is a pressure in the nip. FIG. 4 shows an ideal pressure distribution by a solid line. The shape of the pressure distribution in the fixing nip is desirably such that the pressure increases from a low-pressure P1 (0.05-0.2 MPa) to a high-pressure P3 (0.3-0.5 MPa) from the nip entrance to the exit without drop. This is because if the pressure decreases half way in the nip, an image deviation and/or glossiness non-uniformity may occur.

When the sheet P passes in the nip, the sheet P is heated from the position of the nip entrance, and the temperature has a peak temperature at the nip exit. Therefore, by applying a high-pressure at the nip exit where the toner on the sheet is sufficiently melted, the image can be efficiently fixed on the sheet P. In FIG. 4, the pressure P2 (approx. 0.2 MPa) is the pressure which is preferable to separate the sheet P from the fixing roller 51. By the pressure applied by the separation roller 56, the rubber layer of the fixing roller 51 deforms to assist the separation of the sheet using the curvature. The fixing device 9 of this embodiment can provide a desired fixing property by the fixing nip in which the low pressure portion and the high pressure portion are adjacent to each other.

(Moving Mechanism and Operation Thereof)

The description will be made as to a changing mechanism (moving mechanism) for changing a relative positional relation between the fixing roller 51 and the pressing unit 53, between a press-contact position in which the fixing roller 51 and the pressing unit 53 a press contacted to each other and a spacing position in which the fixing roller 51 and the pressing unit 53 are spaced from each other. The moving mechanism of this embodiment effects an engaging and disengaging operation between the fixing roller 51 and the pressing unit 53 by moving the pressing unit.

FIG. 5 is a sectional view illustrating a state (press-contact position) on which the pressing unit 53 is pressed to the fixing roller 51. The separation roller 56 is pressed against the fixing roller 51 by the separation roller spring 56SP through separation roller side plate 56P to constitute a high pressure portion of the fixing nip.

The moving mechanism of this embodiment is a cam mechanism using a pressing cam 200 and a pressing motor 202. When the pressing unit 53 is to be pressed contacted to the fixing roller 51, the moving mechanism drives the pressing motor 202 by a predetermined number of pulses to compress the separation roller spring 56SP. On the other hand, the pressing pad 100 constitutes the low pressure portion in the nip N by the urging force of the pressing pad spring 100SP.

This, the changing mechanism is provided with a cam for changing a distance between the rotatable members constituting the pair.

Figure 6:
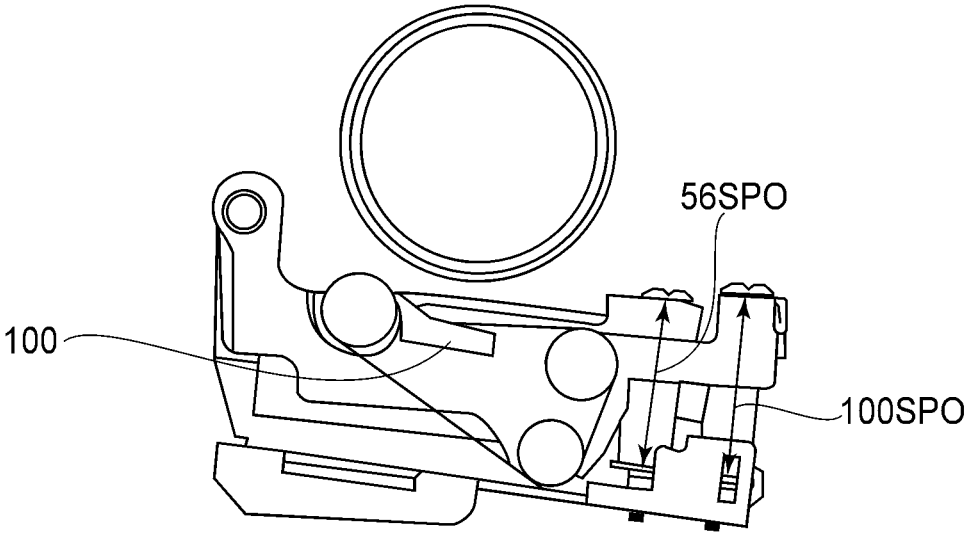
FIG. 6 illustrates the pressing unit in a spaced state of Embodiment 1.

FIG. 6 is a sectional view illustrating a state (first spacing position) in which the pressure of the pressing unit 53 to the fixing roller 51 is released. The fixing nip is released by the pressing unit 53 spacing from the fixing roller 51. When the fixing nip is released, in the separation roller 56 and the pressing pad 100 is moved upwardly by the urging forces of the compression springs and is stopped by abutting to the stoppers. More particularly, the abutting portion of the upper surface of each side plate is abutted to the lower surface of the screw.

Referring to parts (a) and part (b) of FIG. 7 (flow chart and block diagram), a fixing nip forming operation using the movement of the pressing unit 53 will be described. When the pressing instructions is produced by the control circuit 201 as the controlling means (controller) (S7-001), the motor driver 203 drives the pressing motor 202 in a CW direction by a predetermined number of rotations (N) (S7-002). By the rotation of the pressing cam 200, the moving mechanism moves the pressing unit 53 to the pressing position. The control circuit 201 comprises a CPU having calculation functions and memory for storing information. It functions as a controller for effecting the various controls by reading programs out of the memory and executing them. In this embodiment, the control circuit 201 functions as a pause time calculation portion 201*a* and an engagement and disengagement controller 201*b* which will be described hereinafter.

By the pressing unit 53 moving to the pressing position (S7-003), the fixing nip is established (S7-004). Similarly, when space instructions are produced by the control circuit 201 (S7-005), the pressing motor 202 is driving in a CCW direction by a predetermined number of the rotations (R) (S7-006), the pressing unit 53 is moved to the spacing position (S7-007), by which the fixing nip is released (S7-008).

That is, the cam rotates in one direction when the positional relation between the fixing roller 51 and the pressing unit 53 is changed from the contacting position to the first spacing position.

When the positional relation is change from the contacting position to a second spacing position, the cam is rotated in one direction.

When the positional relation is change from the first spacing position to the contacting position, the cam is rotated in the other direction. When the positional relation is changed from the second spacing position to the contacting position, the cam is rotated in the other direction.

When the fixing nip is established by the movement of the pressing unit 53 from the spacing position to the pressing position, the pressing pad 100 presses the pressing belt 52 to the fixing roller 51 earlier than the separation roller 51. By this, the peak pressure by the pressing pad 100 is first provided in the fixing nip N. For this reason, the free end portion 100*a* of the pressing pad is stably inserted into the gap between the separation roller 56 and the fixing roller 51. Therefore, a continuous pressure distribution can be provided in the fixing unit, using the pressing pad 100 and the separation roller. That is, a production of the pressure void portion in the fixing nip can be suppressed, and therefore, the image disturbance attributable to the expansion of the stagnating air and/or production of the water vapor in the fixing nip can be suppressed.

(Temporary Spacing Mode)

A temporary spacing mode of the image fixing apparatus 9 of this embodiment will be described. The fixing device 9 of this embodiment temporarily spaces the pressing unit 53 from the fixing roller 51 when the continuous process of image formation is interrupted. This is called temporary spacing mode. The temporary spacing mode is provided to avoid excessive temperature rise of the pressing unit 53, particularly the pressing belt 52 by the heat from the fixing roller 51. If the excessive temperature rise of the pressing belt 52 occurs, the following programs may arise. For example, the sheet P is heated using the fixing roller 51 and the excessively heated pressing belt 52, the toner will be over-melted. This will result in so-called hot offset which may lead to contamination of the surface of the fixing roller with the over-melted toner. In the case of the both side printing, the pressing belt 52 having the excessively high temperature reheat to the back side of the sheet P which is influential to the glossiness of the image. When the excessive temperature rise of the pressing belt 52 occurs, the overheating of the back side of the sheet P may result in production of water vapor. That is, the sheet P is dried. The dried sheet P absorbs moisture after it is discharged to the outside of the image forming apparatus, which will result in waving deformation of the sheet. In addition, the produced water vapor stagnates in the pressure void portion in the fixing nip, image non-uniformity may result.

The control circuit 201 functions as a controller for spacing the pressing unit 53 upon pause (temporary stop) of the fixing operation taking place during the continuously image formation job for a plurality of sheets. The control circuit 201 functions as a controller for returning the pressing unit 53 to the press-contact position upon the image formation resumption (end of the pause of the continuous job).

The temporary spacing mode will be described.

In this embodiment, the pressing unit 53 is movable between the position (engagement position, press-contact position) in which the fixing roller 51 is press contacted by the pressing unit 53 ands positions (spacing position) in which the pressing unit 53 is spaced from the fixing roller 51, the latter positions including a first spacing position and a second spacing position.

The space amounts of the first and second spacing positions a different from each other, more particularly, the space amount of the second spacing position is smaller than that of the first spacing position. In other words, the second spacing position (semi-disengagement position) is between the press-contact position and the first spacing position (disengagement position). FIG. 8 is a sectional view illustrating a second spacing position (semi-release) of the pressing unit 53 relative to the fixing roller 51.

Referring to the flow chart of FIG. 9 and the block diagram of FIG. 10, the control of the temporary spacing mode will be described. A certain point of time of the continuous process job, the image forming operation is temporarily stopped Then, the control circuit 201 acquires information relating to the time period required for resumption.

In this embodiment, this information is predicted that time outputted from the calculation portion 201*a* for calculating the pause time.

The pause arises, when the sheet is switched during the continuous operation job of the fixing device 9. More particularly, for example, when the sheet is switched from a first recording material (plain paper having a basis weight of 105 gsm, for example) to a second recording material (thin sheet having a basis weight of 64 gsm), the job is temporarily stopped in order to change the heating temperature condition. The change of the heating temperature condition does not require long time, and therefore, the time of the pause is 3 sec, for example.

Therefore, the calculation portion 201*a* produces an output indicative of 3 sec of the pause time.

When the switching of the recording material is from a third recording material (thick sheet having a basis weight of 300 gsm, for example) to the second recording material (thin sheet having a basis weight of 64 gsm), the pause time is 5 the, for example, which is relatively longer because of the change of the heating temperature condition is relatively larger. Therefore, the calculation portion 201*a* produces an output indicative of 5 sec of the pause time.

The pause time is longer if the difference in the basis weight between the sheets before and after the switching. In the foregoing example, the switching occurs toward a smaller basis weight, but the similar situations arise when the switching is toward a larger basis weight. For example, the difference in the basis weight when the switching is from the second recording material to the third recording material is larger than when the switching is from the second recording material to the first recording material, and the pause time tends to be longer. In addition, when the switching is to the second recording material having a larger basis weight than that of the third recording material, the pause time may be not less than 6 sec.

The output information of the pause time calculated by the calculation portion 201*a* may be calculated by the control circuit 201, or may be a stored value in a Table stored in the storing portion such as memory beforehand.

The cause of the temporary stop is not limited to the change of the heating temperature condition required by the change of the sheet kind. For example, may be a pause required for switching the sheet cassette (the required pause is as short as 1-2 sec), a pause required for an adjusting operation of the image forming station, or a post-processing operation for the recording paper at the image fixing (the required pause is 5 or more sec). A pause (interruption) of the continuous job required for sheet jam clearance is not predictable, and therefore, this interruption is not deemed as the above-described pause, in this embodiment.

Thus, the calculation portion 201*a* has a function as an acquiring portion for acquiring the information relating to the pause, corresponding to the information relating to the pause state of the image forming station.

A drive controlling portion 201*b* controls the engaging and disengaging drive for the pressing unit 53 on the basis of the output information of the calculation portion 201*a*. More particularly, the drive controlling portion 201*b* makes discrimination as to whether or not the pause time information provided by the calculation portion 201*a* is longer than the time required for the pressing unit 53 to move from the engagement position to the disengagement position (first spacing position) and then to return to the engagement position (S9-002).

In the case of the moving mechanism using the pressing cam in this embodiment, the time required for the reciprocation of the pressing unit 53 between the press-contact position and the first spacing position is a first movement time (6 sec in this embodiment). That is, in this embodiment, the movement from the press-contact position to the disengagement position (first spacing position) is 3 sec (one way).

Changing mechanism reciprocates the relative position of the rotatable member between the contacting position and the first spacing position in the first time.

In the case of the moving mechanism using the pressing cam of this embodiment, a second movement (4 sec in this embodiment) is required for the reciprocation of the pressing unit 53 between the press-contact position and the second spacing position. That is, in this embodiment, the time required for the movement from the press-contact position to the semi-disengagement position (second spacing position) is 2 sec (one way). This, the second time required for the recitation of the relative movement between the contacting position and the second spacing position is shorter than the first time.

In this embodiment, the information relating to the time required for the reciprocations is stored in the memory of the control circuit 201, and the drive controlling portion 201 reads this information out In this embodiment, the press-contact position where the opposing member is press-contacted to the first rotatable member during the fixing operation is one fixed position. In other words, the position upon the start of the moving mechanism for the pause of the fixing operation and the position upon the image formation resumption are the same press-contact position.

The drive controlling portion 201*b* makes the following discrimination when the pause time outputted by the calculation portion is longer than the time required for the reciprocation of the pressing unit 53 between the press-contact position and the disengagement position. The drive controlling portion 201*b* selects the disengagement position (first spacing position) as the spacing position in the pause period (S9-003).

Here, the reciprocation means that the pressing unit 53 moved to the disengagement position (first spacing position) and returns to the engagement position.

In other words, the control circuit 201 functions as the controller for controlling the changing mechanism such that the continuous process is interrupted for a period longer than the first time, the positional relationship between the fixing roller 51 and the pressing unit 53 becomes the first spacing position relationship.

In addition, the control circuit 201 functions as a controller for controlling the changing mechanism such that the positional relation between the fixing roller 51 and the pressing unit 53 is the second spacing position relationship, when the continuous process is interrupted for a period shorter than the first time and longer than the second time, The drive controlling portion 201*b* makes the following discrimination when the pause time outputted by the calculation portion is shorter than the time required for the reciprocation of the pressing unit 53 between the press-contact position and the disengagement position.

The drive controlling portion 201*b* makes discrimination as to whether or not the pause time outputted by the calculation portion is longer than the time period required for the reciprocation of the pressing unit 53 between the press-contact position and the semi-disengagement position (4 sec) (S9-004).

When the pause time outputted by the calculation portion is longer than 4 sec, the drive controlling portion 201*b* selects the semi-disengagement position (second spacing position) as the spacing position in the pause.

When the pause the outputted by the calculation portion is shorter than 4 sec, the drive controlling portion 201*b* selects non-execution of the spacing operation of the pressing unit 53 in the pause period (S9-008).

That is, when the pause time outputted by the calculation portion is longer than 4 sec and shorter than 6 sec, the drive controlling portion 201*b* selects the semi-disengagement position (second spacing position) as the spacing position in the pause period (S9-005). The spacing position selected (determined) by the drive controlling portion 201*b* is transmitted from the drive controlling portion 201*b* to the motor driver 203. The pressing motor 202 is driven by the motor driver 203 to rotate in the CCW direction. By this, the pressing unit 53 is moved to the selected spacing position (S9-006). That is, the control circuit 201 functions as the controller for controlling the changing mechanism (more particularly the pressing motor 203).

Thereafter, at the timing of the end of the pause time, the motor driver 203 rotates the pressing motor 202 in the CW direction to return the pressing unit 53 to the press-contact position.

When the acquired pause time is shorter than 4 sec, the temporary spacing of the pressing unit 53 it is not carried out, that is, the contact position is maintained (S9-008). Thereafter, the image forming operation is resumed (S9-009). That is, the rotatable members are contacted to each other before the first sheet after the resumption of the continuous process reaches the nip.

As described in the foregoing, according to the present invention, when the pause time during the continuous process job is 4-6 sec, the pressing unit 53 is placed in the semi-disengagement position (second spacing position) which is between the engagement position of FIG. 5 and the disengagement position (first spacing position) of FIG. 6. That is, when the pause time is short, the pressing unit is spaced to the position (second spacing position) which is closer to the fixing roller 51 than the normal spacing position (first spacing position). With such a structure, the pressing unit 53 can be spaced from the fixing roller 51 even if the pause period is short as in the case of the switching of the kind of paper during the continuous job. Therefore, the excessive heating of the pressing unit 53, particularly the pressing belt 52, by the fixing roller 51 can be suppressed. Therefore, the production of the image defect attributable to the high temperature of the pressing belt 52 and the resumption of the image formation job can be avoided. With the above-described structure, the pressing unit 53 can be engaged to and disengaged from the fixing roller 51 quickly. Therefore, the pressing unit 53 can be brought back into the engagement state from the disengagement state relative to the fixing roller 51, by the time of the resumption of the job, even when the pause period is short as when the kind of paper is switched during the continuous job. Therefore, an additional delay (pause) attributable to the failure of the establishment of the engagement state between the pressing unit 53 and the fixing roller 51 can be avoided. According to the present invention, the reduction of the throughput by the fixing device can be suppressed. In other words, according to the present invention, the image forming apparatus is capable of resuming the image forming operation is without down time which may otherwise result from the provision of the temporary spacing mode, and in addition the temperature rise of the pressing member can be suppressed.

Embodiment 2

The image forming apparatus and the fixing device of this embodiment have the structures similar to those of Embodiment 1, but there are provided a plurality of press-contact positions of the pressing unit 53 relative to the fixing roller 51 corresponding to kinds of the recording paper in this embodiment. Therefore, the time required for the pressing unit 53 to move from the press-contact position to a predetermined spacing position (first spacing position or second spacing position) and to return to the press-contact position is different from the press-contact position taken at the time of start or end of the temporary spacing mode.

Therefore, with the structure of Embodiment 1, the temporary spacing position cannot be optimized. In this embodiment, the calculation portion calculates a first spacing time required for the reciprocation is between the press-contact position and a second spacing time required for the reciprocation between the press-contact position and the second spacing position.

(Temporary Spacing Mode)

Referring to FIG. 11 (flow chart) and FIG. 12 (block diagram), the control in the temporary spacing mode in this embodiment will be described. In Embodiment 1, the time required for the pressing unit to move to the disengagement position (first spacing position) and to return to the engagement position is fixed at 6 sec, and the time required for the pressing unit to move to the semi-disengagement position (second spacing position) and to return to the engagement position is fixed at 4 sec. In this embodiment, the number of the press-contact positions of the pressing unit 53 relative to the fixing roller 51 during the fixing operation is plural, and the time required for the returning from the engagement position to the contact position is calculated under the condition that the press-contact positions upon the start and the end of the temporary spacing mode are different.

In this embodiment, when the image formation is interrupted during the continuous process job, the pause time (T) as the predicted time is acquired from the calculation portion 201*a*, similarly to Embodiment 1. Then, in this embodiment, the time required for the pressing unit 53 to move to the disengagement position (first spacing position) and to return to the engagement position is calculated as a first spacing time (R1). Similarly, the time required for the pressing unit 53 to move to the semi-disengagement position (second spacing position) and to return to the engagement position is calculated as a second spacing time (R2) by a disengageable time calculation portion 201*c* (S11-010).

Here, the discrimination is made by the engagement and disengagement controller 201*b* as to whether or not the calculated pause time (T) Is longer than the first spacing time (R1) calculated by the disengageable time calculation portion 201*c* (S11-002). If T>R1, the disengagement position (first spacing position) is selected as the temporary spacing position (S11-003). If not, the discrimination is made as to whether or not the pause time (T) is longer than the second spacing time (R2) calculated by the disengageable time calculation portion 201*c*.

If T>R2, the semi-disengagement position (second spacing position) is selected as the temporary spacing position (S11-005). The determined spacing position is transmitted from the engagement and disengagement controller 201*b* to the motor driver 203, and the pressing motor 202 is rotated in the CCW direction. By this, the pressing unit 53 is moved to the selected spacing position (S11-006). By the pressing motor 202 rotating in the CW direction, the pressing unit 53 is returned to the press-contact position.

If not, no temporary spacing of the pressing unit 53 is carried out (S11-008). Thereafter, the image forming operation is resumed (S11-009).

As described in the foregoing, even when there are provided a plurality of the press-contact positions of the pressing unit 53 relative to the fixing roller 51, the time required for execution of the temporary spacing mode is calculated from the information of the press-contact position upon the start and end of the temporary spacing mode operation and is compared with the predicted pause time period. By this, the optimum spacing position can be determined. Therefore, the image formation can be resumed without down time which is otherwise necessitated by the temporary spacing mode, and the temperature rise of the pressing member can be minimized.

MODIFIED EXAMPLES

In the foregoing, the description has been made as to the embodiments of the present invention, but the present invention is not limited to these examples, and can be modified within the present invention.

Modified Examples 1

In the foregoing embodiments, the controlling means for controlling the operation of the moving means during the continuous job of image formation on a plurality of sheets changes in the relative position between the rotatable members by a first distance when the continuous job is interrupted for the first time period. When the continuous job is interrupted for the second time which is shorter than the first time, the relative position of the rotatable members is changed to a second distance which is shorter than the first distance.

However, the threshold for the discrimination of the pause time is not limited to those described in the foregoing, but the discrimination may be made such that when the continuous job is interrupted for a time period longer than a predetermined period, the rotatable members are spaced by the first distance, and when the continuous job is interrupted for a time period shorter than the predetermined period, the rotatable members are spaced by a second distance which is shorter than the first distance.

In the foregoing embodiments, when the continuous job is interrupted for the third time which is shorter than the second time, the continuous job is resumed without spacing between the rotatable members, but the present invention is not limited to these examples. For example, the rotatable members may be spaced by a second distance when the continuous job is interrupted for the third time which is shorter than the second time. Or, when the continuous job is interrupted for the third time which is shorter than the second time, the rotatable members may be spaced by a third distance with shorter than the second distance, in such a case can be said two second distances are provided, and one of them is the third distance.

Modified Example 2

In the foregoing embodiments, the first rotatable member this fixing roller, but the present invention is not limited to these examples, and it may be an endless belt or film. In the foregoing embodiments, the second rotatable member is the pressing belt, but the present invention is not limited to these examples, and it may be pressing roller. However, when the second rotatable member is a belt, the above-described production of the image non-uniformity in the form of icicles can be suppressed.

In the foregoing embodiments, the opposing member is pressed against the first rotatable member, but the present invention is not limited to such examples, but the similarly applicable to the case in which the opposing member is pressed by the first rotatable member.

Modified Example 3

In the foregoing embodiments, the heating source is a halogen heater, but the present invention is not limited to such examples, but the heating source may be an excitation coil (induction heating). Or, the heating source may be such that the heat is directly generated by supplying the electric power to the endless belt (film) per se as the fixing member.

Modified Example 4

In the foregoing embodiments, the sheet a recording paper, but the present invention is not limited to such examples. The sheet may be a regular or irregular sheet of paper, a thick sheet of paper, an envelope, postcard, seal, a resin material sheet, an OHP sheet, glossy paper or the like. The sheet is not limited to the sheet of paper.

Modified Example 5

In the foregoing embodiments, the fixing device is taken as an example, but the present invention is not limited to these examples, but is applicable to a heat pressing the toner image temporary fixed on the sheet to improve the glossiness of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-105180 filed on May 21, 2014, which is hereby incorporated by reference herein in its entirety.

What is claimed is:

1. An image forming apparatus comprising:

an image forming portion configured to form a toner image on a sheet during an image forming process, said image forming portion including a heating member and a pressing member configured to form a fixing nip for fixing the toner image formed on a sheet therebetween;

a moving mechanism configured to move at least one of said heating member and said pressing member to change the relative position therebetween, between a first relative position where said heating member and said pressing member are in contact with each other, a second relative position where said heating member and said pressing member are spaced from each other by a first distance, and a third relative position where said heating member and said pressing member are spaced from each other by a second distance that is shorter than the first distance; and a controller configured to interrupt the image forming process for plural sheets after a preceding sheet passes through the fixing nip and before a subsequent sheet reaches the fixing nip, said controller also being configured to insert one of a plurality of interrupting processes including a first interrupting process over a first predetermined period and a second interrupting process over a second predetermined period that is shorter than the first predetermined period, while the image forming process is interrupted, wherein said moving mechanism places said heating member and said pressing member at the second relative position when the first interrupting process is inserted, and places said heating member and said pressing member at the third relative position when the second interrupting process is inserted.

2. An apparatus according to claim 1, wherein when a third interrupting process over a third predetermined period, which is shorter than the second predetermined period, is inserted during the interruption of the image forming process, said moving mechanism maintain the first relative position.

3. An apparatus according to claim 1, wherein said moving mechanism is further configured to move at least one of said heating member and said pressing member to a fourth relative position where said heating member and said pressing member are spaced from each other by a third distance, which is shorter than the second distance, and wherein when a third interrupting process over a third predetermined period, which is shorter than the second predetermined period, is inserted during the interruption of the image forming process, said moving mechanism changes the relative position to the fourth relative position.

4. An apparatus according to claim 1, wherein the first interrupting process raises the temperature of said heating member from a first target temperature to a second target temperature higher than the first target temperature, and the second interrupting process raises the temperature of said heating member from the first target temperature to a third target temperature lower than the second target temperature and higher than the first target temperature.

5. An apparatus according to claim 1, wherein said moving mechanism includes a cam configured to change the distance between said heating member and said pressing member, wherein when the relative position is changed from the first relative position to the second relative position, said cam is rotated in one direction, wherein when the relative position is change from the second position to the first relative position, said cam is rotated in the other direction, wherein when the relative position is changed from the first relative position to the third relative position, said cam is rotated in said one direction, and wherein when the relative position is changed from the third relative position to the first relative position, said cam is rotated in the other direction.

6. An image forming apparatus comprising:

an image forming portion configured to form a toner image on a sheet during an image forming process, said image forming portion including a heating member and a pressing member configured to form a fixing nip for fixing the image formed on the sheet therebetween, and including a heating source configured to heat to raise the temperature of said heating member to a target temperature;

a moving mechanism configured to move at least one of said heating member and said pressing member to change the relative position therebetween, between a first relative position where said heating member and said pressing member are in contact with each other, a second relative position where said heating member and said pressing member are spaced from each other by a first distance, and a third relative position where said heating member and said pressing member are spaced from each other by a second distance that is shorter than the first distance; and a controller configured to interrupt the image forming process for plural sheets after a preceding sheet passes through the fixing nip and before a subsequent sheet reaches the fixing nip, said controller also being configured to insert one of a plurality of interrupting processes including a first interrupting process for raising the temperature of said heating member from a first target temperature to a second target temperature higher than the first target temperature by controlling said heating source and a second interrupting process for raising the temperature of said heating member from the first target temperature to a third target temperature lower than the second target temperature and higher than the first target temperature by controlling said heating source, while the image forming process is interrupted, wherein said moving mechanism places said heating member and said pressing member at the second relative position when the first interrupting process is inserted, and places said heating member and said pressing member at the third relative position when the second interrupting process is inserted.

7. An apparatus according to claim 6, wherein when a third interrupting process for raising the temperature of said heating member from the first target temperature to a fourth target temperature lower than the third target temperature and higher than the first target temperature is inserted during interruption of the image forming process, said moving mechanism maintains the first relative position.

8. An apparatus according to claim 6, wherein said moving mechanism is further configured to move at least one of said heating member and said pressing member to a fourth relative position where said heating member and said pressing member are spaced from each other by a third distance, which is shorter than the second distance, and wherein when a third interrupting process for raising the temperature of said heating member from the first target temperature to a fourth target temperature lower than the third target temperature and higher than the first target temperature is inserted during interruption of the image forming process, said moving mechanism changes the relative position to the fourth relative position.

9. An apparatus according to claim 6, wherein said moving mechanism includes a cam configured to change the distance between said heating member and said pressing member, wherein when the relative position is changed from the first relative position to the second relative position, said cam is rotated in one direction, wherein when the relative position is change from the second relative position to the first relative position, said cam is rotated in the other direction, wherein when the relative position is changed from the first relative position to the third relative position, said cam is rotated in said one direction, and wherein when the relative position is changed from the third relative position to the first relative position, said cam is rotated in the other direction.

* * * * *